US006301922B1

(12) United States Patent
Ochi

(10) Patent No.: US 6,301,922 B1
(45) Date of Patent: Oct. 16, 2001

(54) AIR CYCLING TYPE AIR-CONDITIONER

(75) Inventor: Osamu Ochi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/509,581

(22) PCT Filed: Aug. 24, 1998

(86) PCT No.: PCT/JP98/03751

§ 371 Date: Mar. 29, 2000

§ 102(e) Date: Mar. 29, 2000

(87) PCT Pub. No.: WO99/17065

PCT Pub. Date: Apr. 8, 1999

(30) Foreign Application Priority Data

Sep. 29, 1997 (JP) ..... 9-264175

(51) Int. Cl.[7] ..... F25D 9/00; F25D 17/04; F25B 5/00

(52) U.S. Cl. ..... 62/402; 62/87; 62/176.4

(58) Field of Search ..... 62/401, 402, 86, 62/87, 176.1, 176.3, 176.4, 176.6

(56) References Cited

U.S. PATENT DOCUMENTS

| | | | | |
|---|---|---|---|---|
| 2,784,571 | * | 3/1957 | Schelp | 62/402 |
| 3,878,692 | * | 4/1975 | Steves | 62/87 |
| 4,580,406 | * | 4/1986 | Nims | 62/87 |
| 5,121,610 | * | 6/1992 | Atkinson et al. | 62/151 |
| 5,402,967 | * | 4/1995 | Hughes | 244/129.2 |
| 5,555,745 | * | 9/1996 | Agahi et al. | 62/401 |

FOREIGN PATENT DOCUMENTS

| | | | |
|---|---|---|---|
| 62102061 | * | 5/1987 | (JP) . |
| A62223572 | | 10/1987 | (JP) . |
| A297851 | | 4/1990 | (JP) . |
| A297852 | | 4/1990 | (JP) . |
| 3079977 | | 4/1991 | (JP) . |
| 4184049 | * | 7/1992 | (JP) . |
| 5223375 | * | 8/1993 | (JP) . |
| 6207755 | | 7/1994 | (JP) . |

* cited by examiner

*Primary Examiner*—William Doerrler

(57) ABSTRACT

An air cycling type air-conditioner includes: a heat exchanger (3); a compressor (1) compressing suction air and transferring the compressed air to the heat exchanger (3), and compressing air transferred from the heat exchanger (3) and transferring the compressed air as supply air; an expander (4) expanding the suction air and transferring the expanded air to the heat exchanger (3), and expanding air transferred from the heat exchanger (3) and transferring the expanded air as the supply air; and a motor (2) driving the compressor (1) and the expander (4). The air-conditioner further includes: a dehumidifier (10) dehumidifying the suction air; a first temperature and humidity measuring unit (12) measuring the temperature and humidity of the suction air; and a control unit (14) calculating the amount of dehumidification on the basis of the temperature and humidity measured by the first temperature and humidity measuring unit (12) and requested temperature and humidity, and controlling the dehumidifier (10) based on the calculated amount of dehumidification. The suction air is dehumidified by the dehumidifier (10) during the room cooling operation, so that the water is prevented from being condensed even when the temperature of the air is lowered by the heat exchanger (3) and the expander (4). Thus, the efficiency of the air-conditioner as a whole is improved.

7 Claims, 5 Drawing Sheets

AIR CYCLING TYPE AIR-CONDITIONER

This application is the national phase under 35 U.S.C. § 371 of PCT International Application No. PCT/JP98/03751 which has an International filing date of Aug. 24, 1998, which designated the United States of America.

TECHNICAL FIELD

The present invention relates to an air cycling type air-conditioner at least including a compressor, a motor, a heat exchanger and an expander, which receives air via a prescribed suction port, performs heat exchange of the received air, and exhausts the resultant air via an outlet port. More particularly, the present invention relates to an air cycling type air-conditioner that is capable of controlling the temperature and the humidity at the same time, preventing the inner portion of the device from rusting, lowering the temperature of the air to or below the freezing point, and setting the absolute humidity of supply air higher than that of suction air during room heating.

BACKGROUND ART

In recent years, air cycling type air-conditioners which can operate both for room cooling and room heating have been widely spreading. FIG. 1 is a block diagram showing a schematic configuration of a conventional air cycling type air-conditioner, which includes: a compressor 1; a motor 2; a heat exchanger 3; an expander 4; four-way valves 5–7 which switch air flow paths during the room cooling or heating operation; an air suction port 8; and an air outlet port 9.

In FIG. 1, the arrows with solid lines show the air flow paths at the time of room cooling. The arrows with broken lines show the air flow paths at the time of room heating. Four-way valve 5 is provided to prevent suction of the air via suction port 8 and exhaust of the air via outlet port 9 from being replaced by each other during the room cooling and room heating operations.

More specifically, at the time of room cooling, four-way valve 5 is switched to attain communication as shown in the solid lines, so that suction port 8 communicates with an inlet of compressor 1 via four-way valve 6, and outlet port 9 communicates with an outlet of expander 4 via four-way valve 7. Conversely, at the time of room heating, four-way valve 5 is switched to communicate as shown in the broken lines, so that suction port 8 communicates with an inlet of expander 4 via four-way valve 7, and outlet port 9 communicates with an outlet of compressor 1 via four-way valve 6.

Further, at the time of room cooling, four-way valve 6 is switched to attain communication as shown in the solid lines, whereby the inlet of compressor 1 communicates with suction port 8 via four-way valve 5 and the output of compressor 1 communicates with heat exchanger 3. Conversely, at the time of room heating, four-way valve 6 is switched to obtain communication as shown in the broken lines, so that heat exchanger 3 communicates with the inlet of compressor 1, and the outlet of compressor 1 communicates with outlet port 9 via four-way valve 5.

Moreover, at the time of room cooling, four-way valve 7 is switched to attain communication as shown in the solid lines, so that heat exchanger 3 communicates with the inlet of expander 4, and the outlet of expander 4 communicates with outlet port 9 via four-way valve 5. Conversely, at the time of room heating, four-way valve 7 is switched to realize communication as shown in the broken lines, and thus, suction port 8 communicates with the inlet of expander 4 via four-way valve 5, and the outlet of expander 4 communicates with heat exchanger 3.

Thus, during the room cooling operation, the air taken in from suction port 8 is directed via four-way valves 5 and 6 to compressor 1, which compresses the received air to produce high-temperature, high-pressure air. This high-temperature, high-pressure air is directed via four-way valve 6 to heat exchanger 3, in which the air is cooled by heat exchange with refrigerant air or refrigerant water. Further, the cooled, high-pressure air is directed via four-way valve 7 to expander 4, in which the air is adiabatically expanded to low-temperature, normal-pressure air. The resultant air is then exhausted via four-way valves 7 and 5, from outlet port 9.

Conversely, at the time of room heating, the air taken in from suction port 8 is directed via four-way valves 5 and 7 to expander 4, which produces low-temperature, low-pressure air. This low-temperature, low-pressure air is directed via four-way valve 7 to heat exchanger 3, in which the air is heat exchanged with refrigerant air or refrigerant water, whereby normal-temperature, low-pressure air is obtained. Further, this normal-temperature, low-pressure air is directed via four-way valve 6 to compressor 1, in which the air is adiabatically compressed, and high-temperature, normal-pressure air is obtained. The resultant air is exhausted via four-way valves 6 and 5, from outlet port 9. Compressor 1 is driven by motor 2 as well as by motive energy generated by expander 4.

As explained above, in the conventional air cycling type air-conditioner, compressor 1, motor 2, heat exchanger 3, expander 4, and three four-way valves 5–7 are used to selectively perform the room cooling or heating operation.

For the conventional air cycling type air-conditioners as described above, various techniques have been proposed to improve the efficiency of the entire devices. For example, the invention disclosed in Japanese Patent Laying-Open No. 4-184049 is directed to improve the efficiency of the air-conditioner as a whole. In this air-conditioner, compressor 1 is cooled at the time of room cooling, by condensation water generated at heat exchanger 3 or expander 4. Heat exchanger 3 is also cooled by the condensation water, which is sprayed thereon and, when evaporating, removes the heat of vaporization from heat exchanger 3.

The invention disclosed in Japanese Patent Laying-Open No. 5-223375 relates to an air cycling type air-conditioner provided with control means for reducing the rotation number of motor 2 driving compressor 1 in the case where the temperature of the air released from expander 4 attains a prescribed temperature or below, to prevent freezing of the moisture contained in the air from expander 4.

These techniques proposed, however, have not solved the following problems inherent in the conventional air cycling type air-conditioners:

(1) The humidity of the air to be exhausted to the room is uniquely determined based on the temperature and humidity of the air sucked from the room and a temperature requested of the supply air. Thus, the temperature and the humidity critical to the performance of the air-conditioner cannot be controlled simultaneously.

(2) During the room cooling operation, the moisture included in the suction air is also cooled and condensed by heat exchanger 3 or expander 4 simultaneously. Thus, if the humidity in the room is high, the efficiency of the air-conditioner as a whole decreases. This may also cause rusting inside the air-conditioner.

(3) In the case where the air of low temperature is sucked into the air-conditioner, ice particles may be blown off from outlet port 9 when the air released from expander 4 is exhausted to the room. Therefore, the temperature of the air cannot be made at or below the freezing point.

(4) Generally, the absolute humidity of the supply air is desired to be lower during the room cooling operation and to be higher during the room heating operation with respect to the absolute humidity of the suction air. In the conventional air-conditioners, however, the absolute humidity of the supply air cannot be made higher than that of the suction air during the room heating operation.

The present invention is directed to solve the above-described problems. The first object of the present invention is to provide an air cycling type air-conditioner which can control the temperature and humidity simultaneously.

The second object of the present invention is to provide an air cycling type air-conditioner which prevents a decrease in the efficiency of the air-conditioner as a whole even in a room with high humidity, and also prevents rusting inside the air-conditioner.

The third object of the present invention is to provide an air cycling type air-conditioner which prevents ice particles from blowing off even when the temperature of air is set at or below the freezing point.

The fourth object of the present invention is to provide an air cycling type air-conditioner which can set the absolute humidity of supply air higher than that of suction air at the time of room heating.

DISCLOSURE OF THE INVENTION

According to an aspect of the present invention, an air cycling type air-conditioner includes: a heat exchanger; a compressor for compressing suction air and transferring the compressed air to the heat exchanger, and compressing air transferred from the heat exchanger and transferring the compressed air as supply air; an expander for expanding the suction air and transferring the expanded air to the heat exchanger, and expanding air transferred from the heat exchanger and transferring the expanded air as the supply air; a motor for driving the compressor and the expander; a dehumidifier for dehumidifying the suction air; a first temperature and humidity measuring unit for measuring the temperature and humidity of the suction air; and a control unit for calculating the amount of dehumidification on the basis of the temperature and humidity measured by the first measuring unit and requested temperature and humidity, and controlling the dehumidifier based on the calculated amount of dehumidification.

With such a configuration, the suction air is dehumidified by the dehumidifier during the room cooling operation, and the water is not condensed even when the temperature of the air is lowered by the heat exchanger and the expander. Thus, the efficiency of the air-conditioner as a whole is improved.

Preferably, the air cycling type air-conditioner further includes a second temperature and humidity measuring unit for measuring the temperature and humidity of the supply air. In this case, the control unit controls the rotation number of the motor and the amount of dehumidification by the dehumidifier on the basis of the temperature and humidity of the supply air measured by the second measuring unit and requested temperature and humidity.

With such a configuration, the rotation number of the motor and the dehumidification amount of the dehumidifier are controlled based on the temperature and humidity of the supply air measured by the second measuring unit and the temperature and humidity requested of the supply air. Thus, it is possible to set the temperature and humidity of the supply air to desired values.

Preferably, the air cycling type air-conditioner further includes a pipeline for providing condensation water generated by the dehumidification by the dehumidifier, to at least one of the compressor, motor and heat exchanger.

With such a configuration, the condensation water generated by the dehumidifier is provided to at least one of the compressor, motor and heat exchanger, and the temperature in the relevant portion can be lowered to improve the temperature efficiency thereof. Thus, it is possible to improve the efficiency of the air-conditioner as a whole.

Preferably, the efficiencies of the compressor, motor and heat exchanger are calculated, and the condensation water generated by the dehumidification of the dehumidifier is provided to the portion having the worst efficiency.

With such a configuration, the condensation water generated by the dehumidifier is provided to a portion having the worst efficiency among the compressor, motor and heat exchanger. Thus, the temperature at the relevant portion can be lowered to improve the temperature efficiency thereof, whereby the efficiency of the air-conditioner as a whole is improved.

According to another aspect of the present invention, the air cycling type air-conditioner includes: a heat exchanger; a compressor for compressing suction air and transferring the compressed air to the heat exchanger, and compressing air transferred from the heat exchanger and transferring the compressed air as supply air; an expander for expanding the suction air and transferring the expanded air to the heat exchanger, and expanding air transferred from the heat exchanger and transferring the expanded air as the supply air; a motor for driving the compressor and the expander; a humidifier for humidifying the supply air; a first temperature and humidity measuring unit for measuring the temperature and humidity of the suction air; and a control unit for calculating the amount of humidification on the basis of the temperature and humidity measured by the first measuring unit and requested temperature and humidity, and controlling the humidifier based on the calculated amount of humidification.

With such a configuration, the control unit calculates the amount of humidification on the basis of the temperature and humidity measured by the first measuring unit and the requested temperature and humidity, and controls the humidifier based on the calculated amount. Thus, the temperature and humidity in the room can be set to desired values.

Preferably, the air cycling type air-conditioner further includes a second temperature and humidity measuring unit for measuring the temperature and humidity of the supply air. In this case, the control unit controls the number of rotation of the motor and the amount of humidification of the humidifier on the basis of the temperature and humidity of the supply air measured by the second measuring unit and requested temperature and humidity.

With such a configuration, the rotation number of the motor and the humidification amount of the humidifier are controlled based on the temperature and humidity of the supply air measured by the second measuring unit and the temperature and humidity requested of the supply air. Thus, it is possible to set the temperature and humidity of the supply air to desired values.

Preferably, the air cycling type air-conditioner further includes a dehumidifier for dehumidifying the suction air, and a pipeline for providing the humidifier with condensation water generated by at least one of the dehumidifier, heat exchanger and expander.

With such a configuration, the condensation water generated by at least one of the dehumidifier, heat exchanger and expander can be utilized as water supply to the humidifier. Thus, it is possible to improve the efficiency of the air-conditioner as a whole.

BEST MODES FOR CARRYING OUT THE INVENTION

The present invention will now be described in more detail with reference to the embodiments shown in the attached drawings.

First Embodiment

Figure 1:
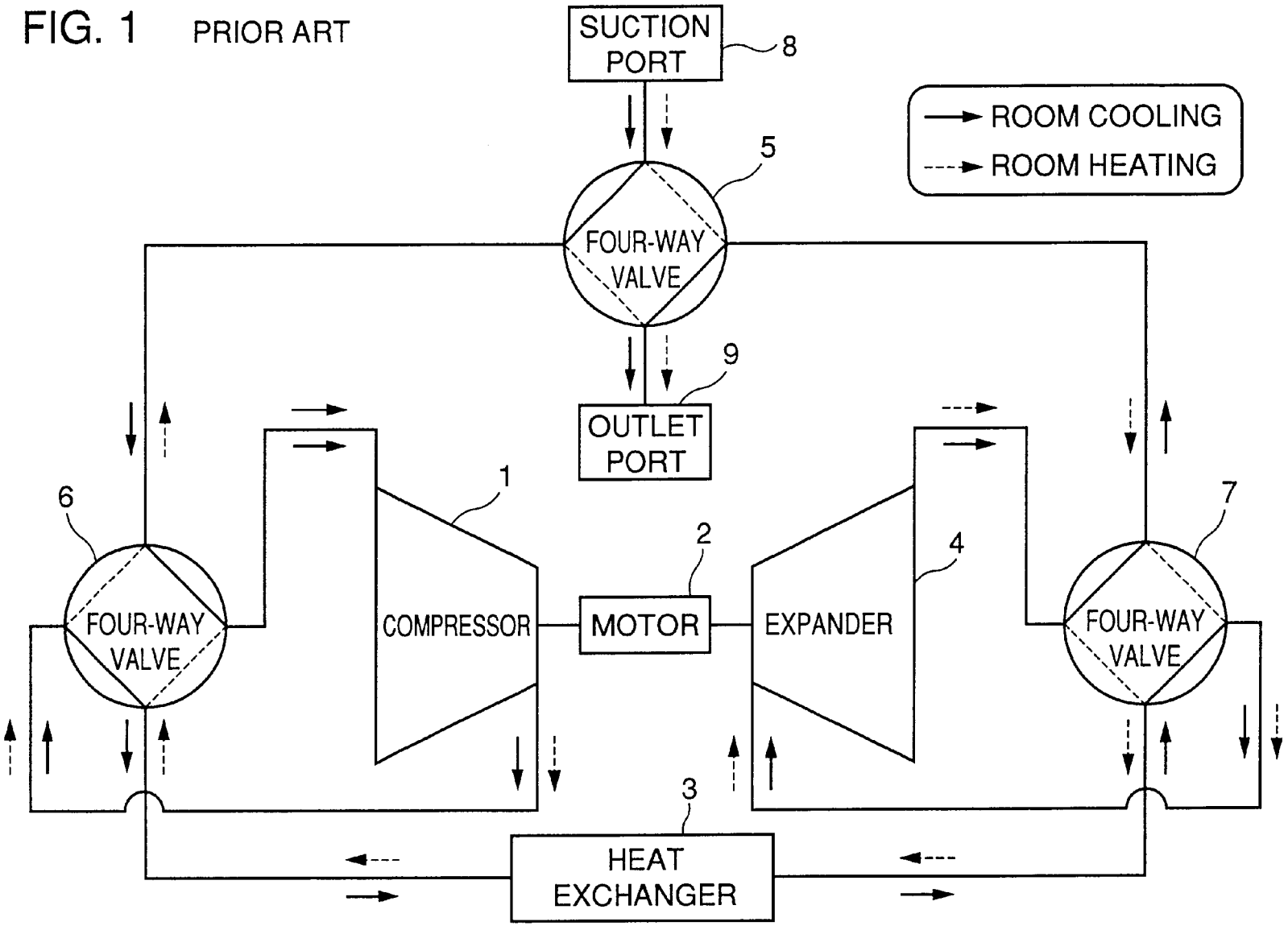
FIG. 1 PRIOR ART
FIG. 1 is a block diagram illustrating the schematic configuration of a conventional air cycling type air-conditioner.
Figure 2:
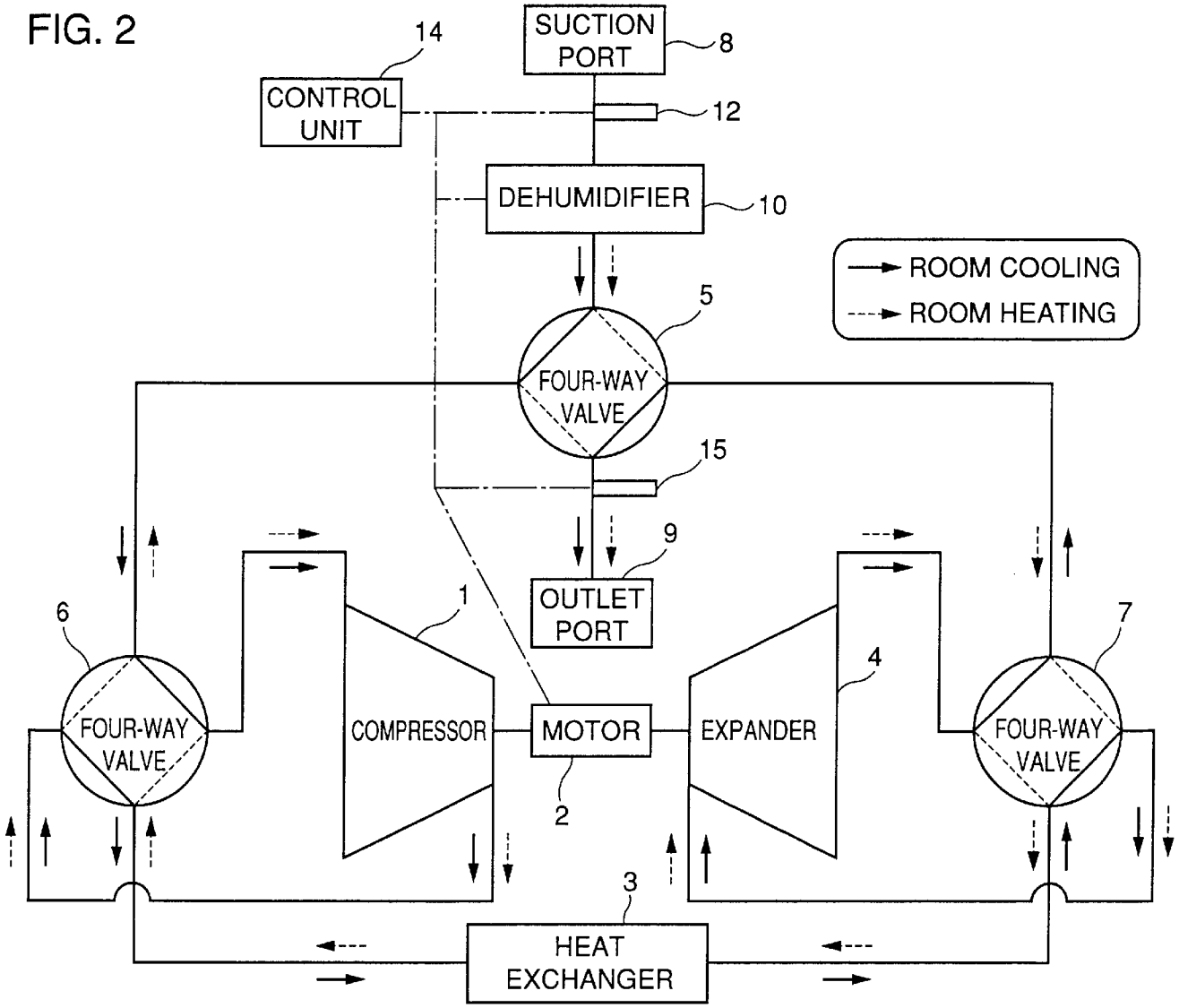
FIG. 2 is a block diagram illustrating the schematic configuration of an air cycling type air-conditioner according to a first embodiment of the present invention.

FIG. 2 is a block diagram illustrating the schematic configuration of the air cycling type air-conditioner according to the first embodiment of the present invention. The air cycling type air-conditioner includes: a compressor 1; a motor 2; a heat exchanger 3; an expander 4; four-way valves 5–7 for switching air flow paths during a room cooling or heating operation; an air suction port 8; an air outlet port 9; a dehumidifier 10; a first temperature and humidity measuring unit 12 for measuring the temperature and humidity of the air taken in from suction port 8; a second temperature and humidity measuring unit 15 for measuring the temperature and humidity of the air exhausted from output port 9; and a control unit 14 for controlling motor 2 and dehumidifier 10 on the basis of the temperature and humidity measured by first and second temperature and humidity measuring units 12 and 15.

In FIG. 2, the arrows with solid lines show the air flow paths during the room cooling operation. The arrows with broken lines represent the air flow paths during the room heating operation. In the air cycling type air-conditioner of the present embodiment, the portions having the same configurations and the same functions as those of the conventional air cycling type air-conditioner are denoted by the same reference characters, and detailed description thereof will not be repeated.

Control unit 14 calculates the amount to be dehumidified on the basis of the temperature and humidity of the air taken in from suction port 8 measured by first measuring unit 12 and the temperature and humidity requested of the supply air, and controls dehumidifier 10 based on the calculated amount of dehumidification. Control unit 14 also detects the difference between the temperature and humidity of the air exhausted from outlet port 9 measured by second measuring unit 15 and the temperature and humidity requested of the supply air, and controls the rotation number of motor 2 for control of the compression of compressor 1, and also controls the amount of dehumidification of dehumidifier 10.

Now, the operation of the air cycling type air-conditioner at the time of room cooling will be described. First temperature and humidity measuring unit 12 measures the temperature and humidity of the room air taken in from suction port 8. Control unit 14 calculates the absolute humidity necessary for the supply air based on the temperature and humidity requested of the supply air. It also calculates the difference between the absolute humidity of the room air measured by first measuring unit 12 and the absolute humidity necessary for the supply air.

Control unit 14 then calculates the flow rate of the suction air based on the input or the rotation number of compressor 1, and, from the flow rate of the suction air and the difference in the absolute humidity as above, calculates the amount of moisture that dehumidifier 10 is required to remove from the suction air per unit of time. Generally, during the room cooling operation, the absolute humidity of the suction air is higher than the absolute humidity requested of the supply air. Therefore, to achieve the temperature and humidity requested of the supply air, dehumidifier 10 dehumidifies by the amount calculated as above. When the air cycling type air-conditioner of the present embodiment is used as a room air-conditioner, the amount of dehumidification during the room cooling operation is normally not greater than about 2 g/sec, although the value would vary due to the use conditions. Therefore, dehumidifiers with relatively low-level capabilities, such as a honeycomb rotor type dry dehumidifier and an adsorptive type dehumidifier, will suffice.

The suction air dehumidified by dehumidifier 10 is directed via four-way valves 5 and 6 to compressor 1, which turns the air to high-temperature, high-pressure air. This high-temperature, high-pressure air is directed via four-way valve 6 to heat exchanger 3, which cools the air by heat exchange with refrigerant air or refrigerant water. Further, the cooled, high-pressure air is directed via four-way valve 7 to expander 4, where the air is adiabatically expanded to low-temperature, normal-pressure air. The resultant air is exhausted via four-way valves 7 and 5, from outlet port 9.

Control unit 14 detects the difference between the temperature and humidity of the supply air measured by second measuring unit 15 and the temperature and humidity requested of the supply air, and controls the rotation number of motor 2 and the amount of dehumidification by dehumidifier 10 to reduce the difference.

As explained above, according to the air cycling type air-conditioner of the present embodiment, dehumidifier 10 dehumidifies the suction air, so that the moisture within the air is prevented from being condensed even when the temperature of the air is lowered by heat exchanger 3 and expander 4. Thus, the efficiency of the entire air-conditioner improves. Further, the difference between the temperature and humidity of the supply air measured by second measuring unit 15 and those requested of the supply air is detected, and the rotation number of motor 2 and the amount of dehumidification of dehumidifier 10 are controlled to reduce the difference. Therefore, it is possible to set the temperature and humidity of the supply air to desired values. Moreover, dehumidifier 10 dehumidifies the suction air, which hinders rusting within the air-conditioner as well as formation of ice particles even when the temperature of the air is lowered to or below the freezing point.

Second Embodiment

Figure 3:
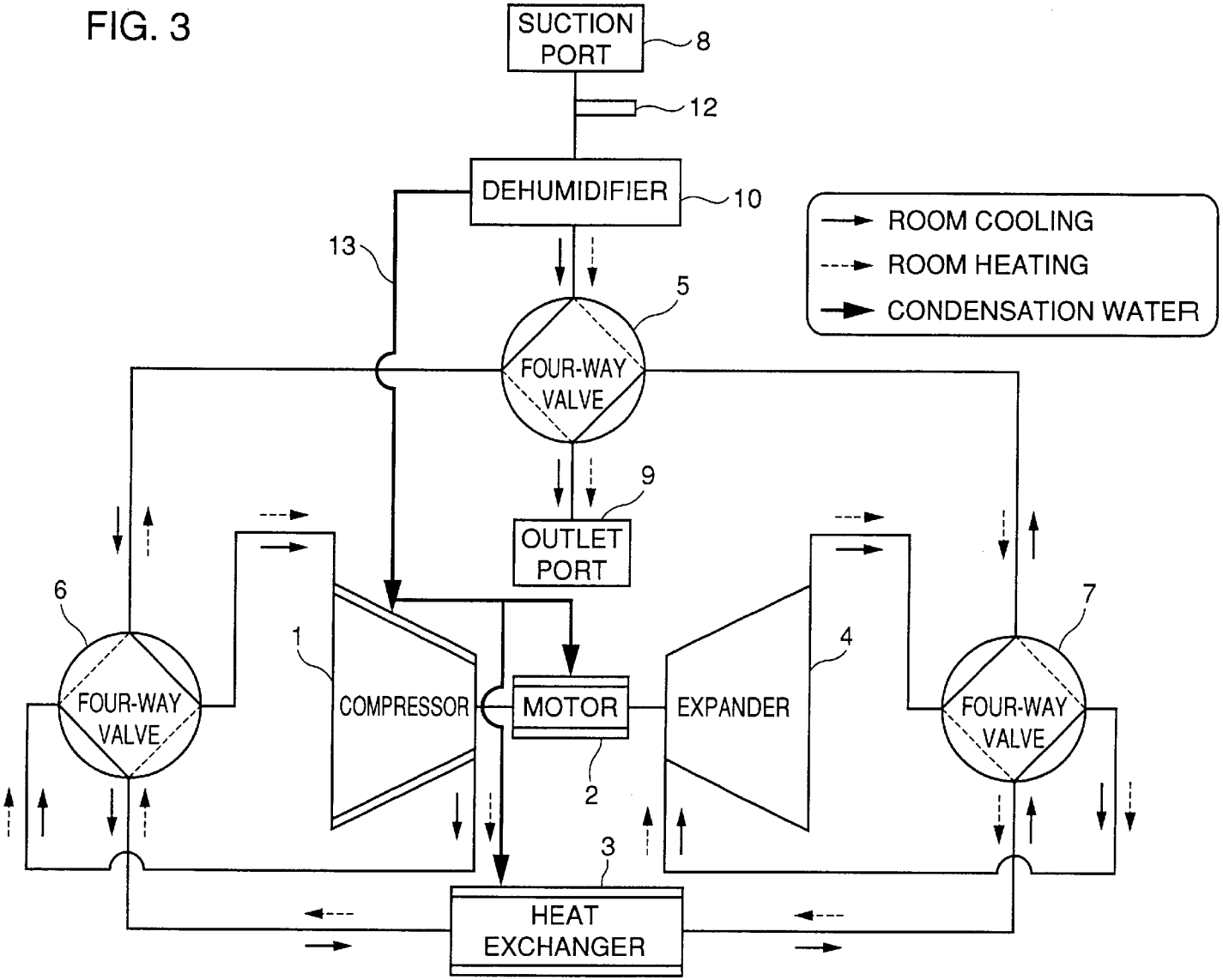
FIG. 3 is a block diagram illustrating the schematic configuration of an air cycling type air-conditioner according to a second embodiment of the present invention.

FIG. 3 is a block diagram illustrating a schematic configuration of the air cycling type air-conditioner according to the second embodiment of the present invention. The air cycling type air-conditioner of the present embodiment is identical to that of the first embodiment shown in FIG. 2, except that it is additionally provided with a pipeline 13 for supplying condensation water generated by dehumidification of dehumidifier 10, to compressor 1, motor 2 and heat exchanger 3. Therefore, the description of the similar configurations and functions thereof is not repeated here.

In FIG. 3, the arrows with solid lines represent the air flow paths during the room cooling operation. The arrows with broken lines show the air flow paths during the room heating operation. Further, the arrows with bold lines represent the transportation paths of the condensation water generated by dehumidifier 10.

The condensation water produced due to the dehumidification by dehumidifier 10 is supplied via pipeline 13 to compressor 1, motor 2 and heat exchanger 3, to cool the components. As explained above, the amount of the condensation water is about2 g/sec, and a flexible, resin tube having an inner diameter of about 2 mm to about 3 mm can be used as pipeline 13. To provide power for transportation of the condensation water, a small pump may be utilized, or alternatively, potential energy may be utilized by placing dehumidifier 10 upper than compressor 1, motor 2 and heat exchanger 3.

The condensation water, generated due to the dehumidification by dehumidifier 10, is supplied via pipeline 13 to compressor 1, motor 2 and heat exchanger 3, where it evaporates and removes the heat therefrom. This improves the temperature efficiencies in compressor 1, motor 2 and heat exchanger 3, and hence, the efficiency of the air-conditioner as a whole. The temperature efficiencies of compressor 1, motor 2 and heat exchanger 3, however, also vary due to the conditions such as the flow rate of the suction air and the temperature of the outdoors. Thus, the condensation water can be supplied in particular to the portion selected from compressor 1, motor 2 and heat exchanger 3 that has the worst temperature efficiency according to the operating conditions of the air-conditioner, to further improve the efficiency of the entire air-conditioner.

Here, the adiabatic efficiency of compressor 1 can be calculated from the measurements of the temperatures of the air at the inlet and the outlet of compressor 1, and the compression ratio of compressor 1. The efficiency of motor 2 can be calculated by first obtaining the correlation between the surface temperature of motor 2 and the efficiency thereof in advance, and by measuring the actual surface temperature of motor 2. Further, the temperature efficiency of heat exchanger 3 can be calculated by measuring the temperatures at the inlet and outlet of heat exchanger 3 at its refrigerant air (or refrigerant water) side and the temperatures at the inlet and outlet of heat exchanger 3 at its cooling side.

As explained above, according to the air cycling type air-conditioner of the present embodiment, the condensation water generated by dehumidification of dehumidifier 10 is supplied to compressor 1, motor 2 and heat exchanger 3. Thus, the temperature of each portion can be lowered to improve the temperature efficiency thereof, and therefore, the efficiency of the air-conditioner as a whole is improved.

Third Embodiment

Figure 4:
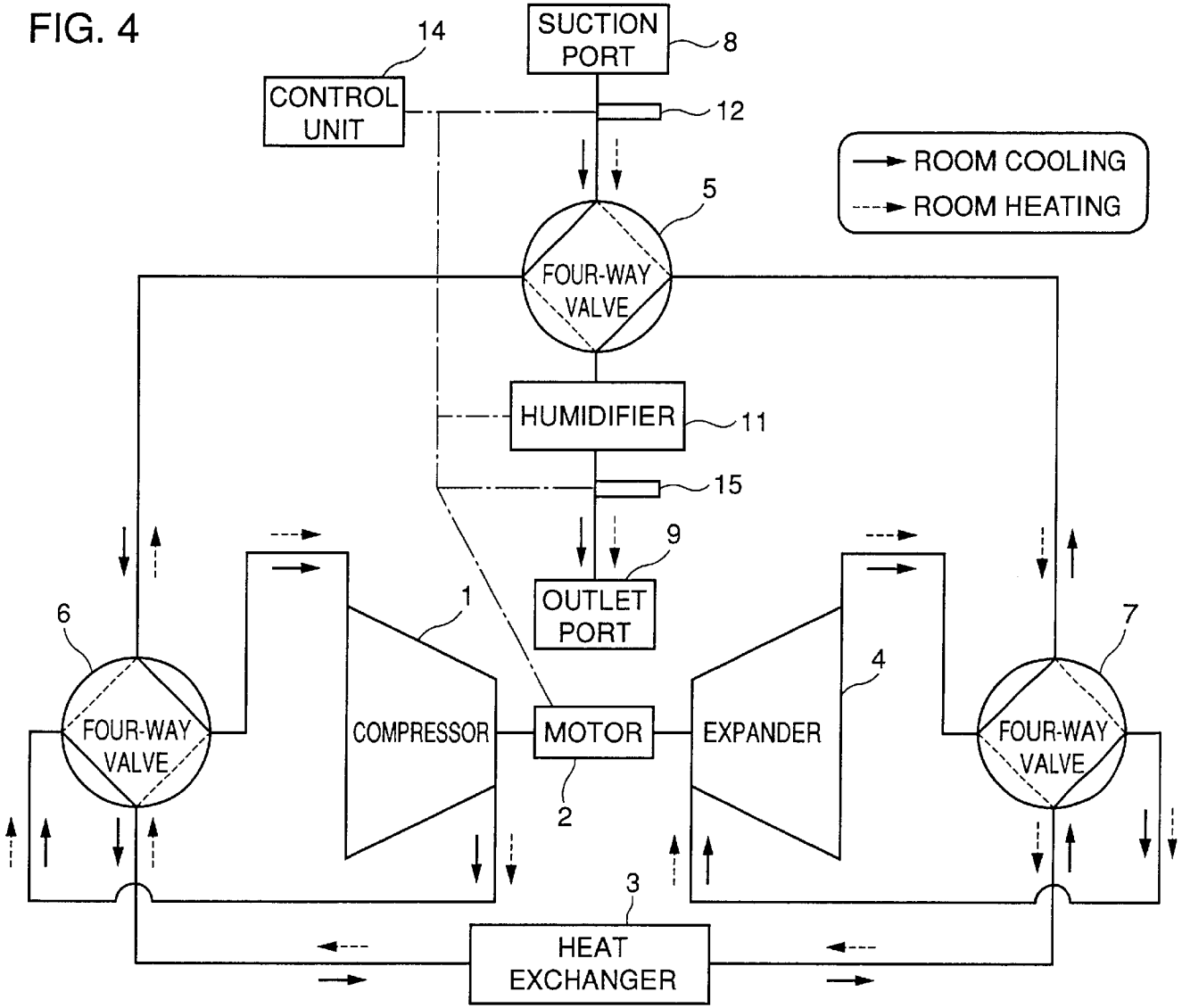
FIG. 4 is a block diagram illustrating the schematic configuration of an air cycling type air-conditioner according to a third embodiment of the present invention.

FIG. 4 is a block diagram illustrating a schematic configuration of the air cycling type air-conditioner according to the third embodiment of the present invention. The air cycling type air-conditioner of the present embodiment is identical to that of the first embodiment shown in FIG. 2, except that dehumidifier 10 found in the first embodiment is removed and a humidifier 11 is provided between four-way valve 5 and second temperature and humidity measuring unit 15. Thus, the description of the same configurations and functions thereof is not repeated here.

In FIG. 4, the arrows with solid lines show the air flow paths at the time of room cooling. The arrows with broken lines represent the air flow paths during the room heating operation.

Control unit 14 calculates the amount of humidification on the basis of the temperature and humidity of the air taken in from suction port 8 measured by first measuring unit 12 and the temperature and humidity requested of the supply air, and controls humidifier 11 based on the calculated amount. Control unit 14 also detects the difference between the temperature and humidity of the air exhausted from outlet port 9 measured by second measuring unit 15 and the temperature and humidity requested of the supply air, and controls the rotation number of motor 2 to control expansion by expander 4, and also controls the amount of humidification by humidifier 11.

Now, the operation of the air cycling type air-conditioner of the present embodiment at the time of room heating will be described. The temperature and humidity of the room air taken in from suction port 8 are measured by first measuring unit 12. Control unit 14 calculates the absolute humidity necessary for the supply air based on the temperature and humidity requested of the supply air. Control unit 14 then calculates the difference between the absolute humidity of the air in the room measured by first measuring unit 12 and the absolute humidity necessary for the supply air.

Control unit 14 also calculates the flow rate of the suction air from the input or rotation number of expander 4, and, based on the flow rate of the suction air and the difference in the absolute humidity as above, calculates the amount of moisture that humidifier 11 should add to the suction air per unit time. Generally, at the time of room heating, the absolute humidity of the suction air is lower than the absolute humidity requested of the supply air. Therefore, to achieve the temperature and humidity requested of the supply air, humidifier 11 humidifies by the amount calculated as above. Humidifier 11 may be a steam jet type humidifier utilizing a heater, or a water spray type humidifier utilizing an ultrasonic wave transducer.

The suction air humidified by humidifier 11 is directed via four-way valves 5 and 7 to expander 4, which turns the air to low-temperature, low-pressure air. This low-temperature, low-pressure air is directed via four-way valve 7 to heat exchanger 3, in which the air is heat exchanged with the refrigerant air or refrigerant water, so that it attains an ordinary temperature. Further, the ordinary temperature, low-pressure air is directed via four-way valve 6 to compressor 1, which compresses the air to produce high-temperature, normal-pressure air. The air is then exhausted via four-way valves 6 and 5, from outlet port 9.

Control unit 14 detects the difference between the temperature and humidity of the supply air measured by second measuring unit 15 and the temperature and humidity requested of the supply air, and controls the rotation number of motor 2 as well as the amount of humidification by humidifier 11 to reduce the difference.

As explained above, according to the air cycling type air-conditioner of the present embodiment, the difference between the temperature and humidity of the supply air measured by second measuring unit 15 and those requested of the supply air is detected, and the rotation number of motor 2 and the amount of humidification of humidifier 10 are controlled to reduce the difference. Therefore, it is possible to set the temperature and humidity of the supply air to desired values.

Fourth Embodiment

Figure 5:
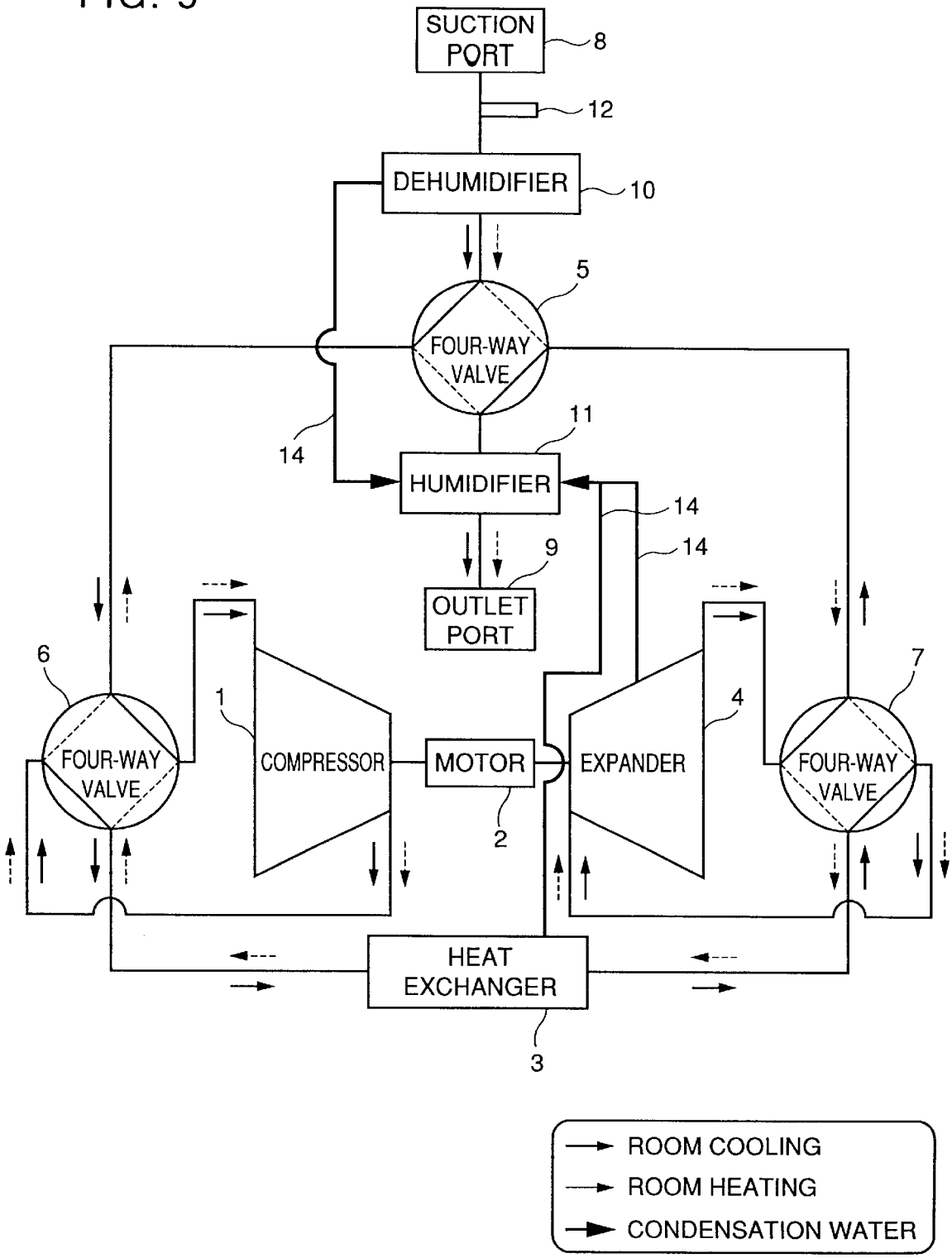
FIG. 5 is a block diagram illustrating the schematic configuration of an air cycling type air-conditioner according to a fourth embodiment of the present invention.

FIG. 5 is a block diagram illustrating a schematic configuration of the air cycling type air-conditioner according to the fourth embodiment of the present invention. The air cycling type air-conditioner of the present embodiment is similar to the air cycling type air-conditioner of the first embodiment shown in FIG. 2, except that it is further provided with a humidifier 11, which is placed between four-way valve 5 and outlet port 9, and a pipeline 14, which supplies condensation water generated at dehumidifier 10, heat exchanger 3 and expander 4, to humidifier 11. Thus, description of the common configurations and functions thereof is not repeated here.

In FIG. 5, the arrows with solid lines represent the air flow paths during the room cooling operation. The arrows with broken lines show the air flow paths during the room heating operation. Further, the arrows with bold, solid lines represent the transportation paths of the condensation water generated at dehumidifier 10, heat exchanger 3, and expander 4.

The condensation water generated at dehumidifier 10, heat exchanger 3, and expander 4 is supplied via pipeline 14 to humidifier 11 as water supply therefor. As in the air cycling type air-conditioner according to the second embodiment, flexible, resin tubes with an inner diameter of about 2 mm to 3 mm can be used as pipeline 14. To provide power for transportation of the condensation water, a compact pump may be utilized, or alternatively, position energy can be utilized by disposing humidifier 11 lower than dehumidifier 10, heat exchanger 3 and expander 4.

As explained above, according to the air cycling type air-conditioner of the present embodiment, the condensation water generated at dehumidifier 10, heat exchanger 3 and expander 4 can be utilized as water supply to humidifier 11. Thus, the efficiency of the air-conditioner as a whole is improved.

What is claimed is:

1. An air cycling type air-conditioner, comprising:

a heat exchanger;

a compressor compressing suction air to transfer to said heat exchanger in a cooling mode and compressing air transferred from said heat exchanger to transfer as supply air in a heating mode;

an expander expanding the suction air to transfer to said heat exchanger in said heating mode, and expanding air transferred from said heat exchanger to transfer as the supply air in said cooling mode;

a motor driving said compressor and said expander;

a dehumidifier dehumidifying said suction air;

a first temperature and humidity measuring unit measuring the temperature and humidity of said suction air; and a control unit calculating the amount of dehumidification on the basis of the temperature and humidity measured by said first temperature and humidity measuring unit and requested temperature and humidity, and controlling said dehumidifier based on the amount of dehumidification.

2. The air cycling air-conditioner to claim 1, further comprising a second temperature and humidity measuring unit measuring the temperature and humidity of said supply air, and said control unit controls the rotation number of said motor and the amount of dehumidification by said dehumidifier based on the temperature and humidity of the supply air measured by said second temperature and humidity measuring unit and said requested temperature and humidity.

3. The air cycling type air-conditioner according to claim 1, further comprising a pipeline supplying condensation water generated by the dehumidification of said dehumidifier, to at least one of said compressor, said motor and said heat exchanger.

4. The air cycling type air-conditioner according to claim 1, further comprising a supply unit calculating efficiencies of said compressor, said motor and said heat exchanger, and supplying the condensation water generated by the dehumidification of said dehumidifier to any of said compressor, said motor and said heat exchanger exhibiting the worst efficiency.

5. An air cycling type air-conditioner, comprising:

a heat exchanger;

a compressor compressing suction air to transfer to said heat exchanger in a cooling mode, and compressing air transferred from said heat exchanger to transfer as supply air in a heating mode;

an expander expanding the suction air to transfer to said heat exchanger in a cooling mode, and expanding air transferred from said heat exchanger to transfer as the supply air in a heating mode;

a motor driving said compressor and said expander;

a humidifier humidifying said supply air;

a first temperature and humidity measuring unit measuring the temperature and humidity of said suction air; and a control unit calculating the amount of humidification on the basis of the temperature and humidity measured by said first temperature and humidity measuring unit and requested temperature and humidity, and controlling said humidifier based on the amount of humidification.

6. The air cycling type air-conditioner according to claim 5, further comprising a second temperature and humidity measuring unit measuring the temperature and humidity of said supply air, and said control unit controls the rotation number of said motor and the amount of humidification by said humidifier based on the temperature and humidity of the supply air measured by said second temperature and humidity measuring unit and said requested temperature and humidity.

7. The air cycling type air-conditioner according to claim 5, further comprising:

a dehumidifier dehumidifying said suction air; and a supply unit supplying condensation water generated by at least one of said dehumidifier, said heat exchanger and said expander, to said humidifier.

* * * * *